United States Patent [19]

Werner

[11] Patent Number: 4,498,657

[45] Date of Patent: Feb. 12, 1985

[54] SIGN STANDARD FOR SUPPORTING AND DISPLAYING A SIGN

[75] Inventor: William A. Werner, 6338 Woodlawn Dr., NE., Salem, Oreg. 97303

[73] Assignee: William A. Werner, Oreg.

[21] Appl. No.: 390,550

[22] Filed: Jun. 21, 1982

Related U.S. Application Data

[63] Continuation of Ser. No. 120,677, Feb. 11, 1980, , which is a continuation-in-part of Ser. No. 950,466, Oct. 11, 1978.

[51] Int. Cl.[3] ..... F16M 13/00

[52] U.S. Cl. ..... 248/623; 248/469

[58] Field of Search ..... 248/160, 475 B, 599, 248/600, 622, 623, 469; 40/602, 608

[56] References Cited

U.S. PATENT DOCUMENTS

| | | | |
|---|---|---|---|
| 492,394 | 2/1893 | Eichberg | 248/623 X |
| 1,416,522 | 5/1922 | Straight | 248/622 |
| 1,532,536 | 4/1925 | Kress | 248/160 |
| 1,759,417 | 5/1930 | Rabsilber | 248/160 X |
| 1,774,742 | 9/1930 | Ash | 248/160 X |
| 1,890,696 | 12/1932 | Rosenhahn | 248/160 X |
| 2,193,747 | 3/1940 | Thompson | 248/160 X |
| 2,590,383 | 3/1952 | Dean | 248/160 X |
| 2,949,324 | 8/1960 | Birge et al. | 40/608 X |
| 2,976,000 | 3/1961 | Gunderson | 248/623 X |
| 3,066,577 | 12/1962 | Gunderson | 248/160 X |
| 3,193,227 | 7/1965 | Czerwinski | 248/623 X |
| 3,620,496 | 11/1971 | Bolt | 248/488 X |
| 3,646,696 | 3/1972 | Sarkisian | 248/160 X |
| 4,033,536 | 7/1977 | Hillstrom | 248/160 |

*Primary Examiner*—William H. Schultz
*Attorney, Agent, or Firm*—Hubbard and Stetina

[57] ABSTRACT

A sign standard in which flexible means for permitting resilient lateral displacement of the sign is mounted closely below the sign, and means for adjusting the height of the sign above the ground, or other surface or a base, is disclosed.

6 Claims, 17 Drawing Figures

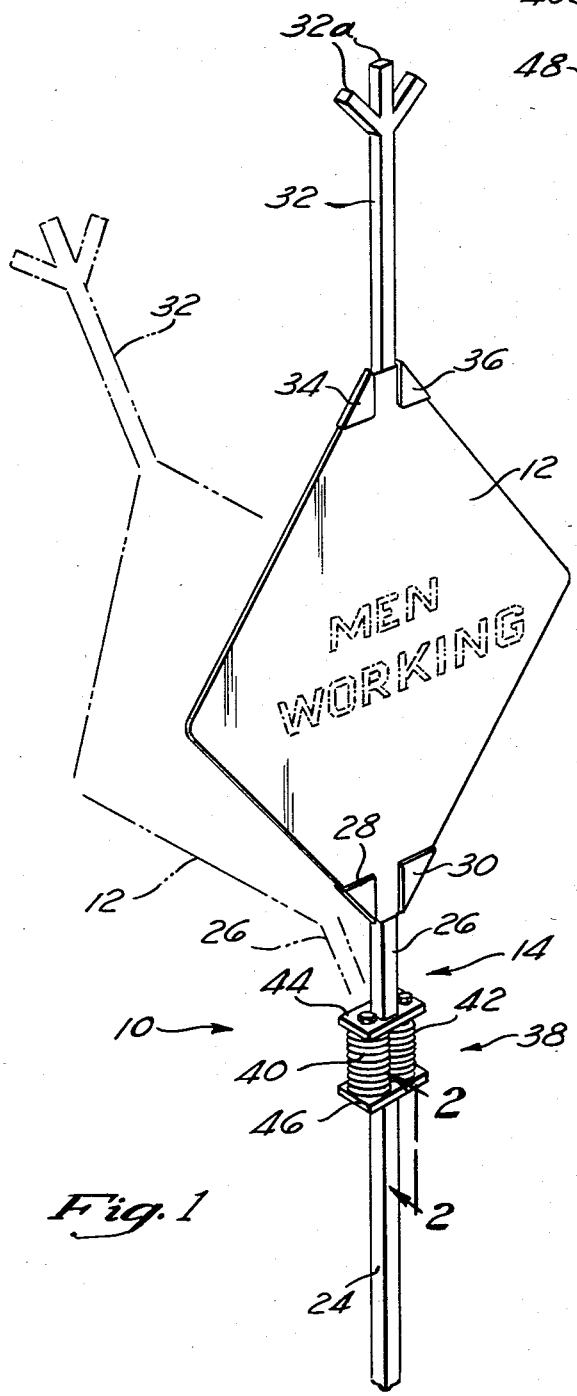
Fig. 1
Fig. 2
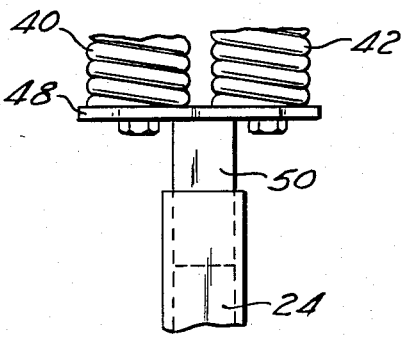
Fig. 5
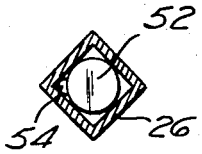
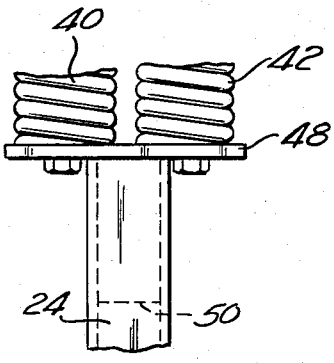
Fig. 3
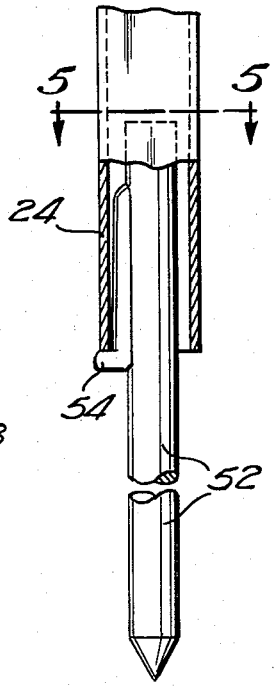
Fig. 4
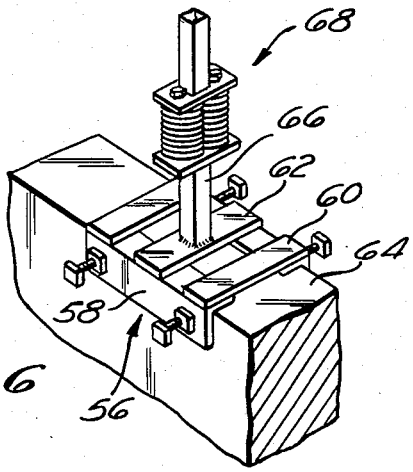
Fig. 6

SIGN STANDARD FOR SUPPORTING AND DISPLAYING A SIGN

CROSS-REFERENCE TO RELATED APPLICATION

This is a continuation of application Ser. No. 120,677, filed Feb. 11, 1980. Which is a continuation-in-part of my copending U.S. application Ser. No. 950,466, entitled SIGN STANDARD FOR SUPPORTING AND DISPLAYING A SIGN, Filed October 11, 1978.

TECHNICAL FIELD

This invention relates to standards for supporting signs in commercial establishments, adjacent and to warn of highway construction and damage, and for general display purposes. More particularly, this invention relates to signs in which specific means are provided to prevent the sign from being dislodged or blown over by the wind.

BACKGROUND

The concept of supporting signs of various types using flexible means to permit the sign to tip is well known. For example, Henne, U.S. Pat. No. 2,292,785, discloses a flexible line marker sign for use in sports in which springs are provided to permit the sign or marker to be bent over. Beck, U.S. Pat. No. 1,532,865, discloses an automobile roadway sign mounted adjacent the roadway which includes springs holding the sign upright but which permit the sign to be run over and forced down parallel to the roadway. Bottcher, Denmark Pat. No. 97,389, discloses a highway sign in which the base is fixed into the ground or otherwise fixed adjacent the highway and which includes a pair of springs holding the sign vertical but permitting the sign to tip. Other signs and objects which are supported by springs are disclosed by Trump, U.S. Pat. No. 2,144,033; Franklin, U.S. Pat. No. 726,187; Watts, U.S. Pat. No. 1,487,635; Lynch, U.S. Pat. No. 1,013,410; Birge, U.S. Pat. No. 2,949,324; Donovan, U.S. Pat. No. 2,164,680; DeVries, Netherland Pat. No. 97,398; Vara, U.S. Pat. No. 3,234,903; Watts, U.S. Pat. No. 1,267,021; Arquero Martin, U.S. Pat. No. 660,595; Hood, U.S. Pat. No. 2,165,704; Werner, U.S. Pat. No. 4,038,769; Sarkisian, U.S. Pat. No. 3,662,482 and Sarkisian, U.S. Pat. No. 3,646,696. Other mechanisms, pivots, for example, for permitting a sign to tilt when acted upon by the wind, the traffic, or otherwise, are also known.

It is conventional, in the prior art, to provide springs adjacent or mounted to the base upon which a sign is supported and permitting to flex. Typical of more recent signs of this type are those disclosed in the Sarkisian and Werner patents cited above. This arrangement is useful but has limitations. For example, this arrangement does not permit the sign to be mounted high above the roadway, floor, or other support surface. Sometimes it is desirable to support a sign high in the air, perhaps six or eight feet high, for better display, to be seen above traffic, to avoid interfering with the flow of traffic, either vehicular or personal traffic, to avoid interference with other signs, displays or structures or for any of a number of other reasons.

It is particularly desirable in connection with portable signs to provide a sign standard which will permit the sign to flex in the wind without tipping the sign over. The desirability of mounting a sign high above the support surface and permitting the sign to flex is not limited, however, to portable signs. Much less rigid and less strong structures may be used to support permanent signs if the sign is permitted to flex in response to the wind, or other moving force, because the force on the standard is less than would be the case if the sign were rigidly mounted on the top of the standard. Thus, the cost of mounting permanent signs may be greatly reduced. In addition, of course, the use of flexible signs is made possible in circumstances where it would not otherwise be possible.

These problems have existed in the prior art and numerous efforts have been made to solve certain of the problems; however, the solution to the elevated sign problem has not heretofore been available. It is, accordingly, one of the features and purposes of the present invention to solve this problem by providing a unique structure and structural relationship between the sign support and the flexible means for supporting the sign.

A brief consideration of the geometry of the conventional approach to providing a flexible support for signs will demonstrate the problem inherent in this approach. If a flexible support is provided on or adjacent the base and an extended post is mounted on the flexible spring or other means on the base, with a sign mounted high on the post, the bending of the post and the sign, in the wind, for example, soon moves the sign outside the support area of the base and, consequently, the base will tip over. In the case of permanent signs, it is undesirable to have the post tilled in most instances because this will interfere with the flow of traffic, interfere with other structures or fall upon other structures, or otherwise become an obstacle. In addition, if the flexible support means must support the weight of the post, as well as of the sign, then severe requirements may be placed upon the design of the spring for supporting the sign and the post. The present invention also encompasses means for adjusting the height of a sign and the supporting flexible means above the surface and improved flexible means for supporting the sign, and means for raising the sign higher without ever changing the size of springs and size and weight of base.

DISCLOSURE OF THE INVENTION

The present invention comprises, in one of its more important facets, a standard for supporting signs in which the flexible means is mounted closely subjacent the sign, and means are provided for spacing the flexible means well above the supporting surface and well above the base or support surface. In addition, means are provided for adjusting the height above the base and above the surface of the spring or other flexible means and the sign. Improved flexible means using a single spring, which may be round or generally rectangular or oval in configuration are also disclosed and comprise important facets of the invention.

In a more specific form, my invention is an improved standard which, in use, supports a sign for display above a support surface and which comprises a base for positioning the standard on the support surface, means for securing a sign to the standard, and resilient means for permitting the sign to tilt in the wind or upon the application of force to a face of the sign, the improvement comprising at least one support post which, in combination with the base, when in use, supports the bottom of the sign a substantial distance of at least about two thirds the height of the sign itself above the support surface, and wherein the resilient means is supported closely subjacent within at least about one foot of the bottom of the sign, whereby the force moment applied to the base is the force moment of the sign distance above the resilient means only and not the force moment of the sign distance above the base.

BRIEF DESCRIPTION OF THE DRAWINGS

FIG. 1 is a perspective view of a standard for supporting a sign illustrating the positioning of the resilient means well above the support surface and closely subjacent to the bottom of the sign.

FIG. 2 is an enlarged view taken along lines 2—2, illustrating the insertion of the support means in an upright coupling or extension means.

FIG. 3 is an enlarged view similar to FIG. 2 illustrating the complete insertion of the support within the coupling means.

FIG. 4 is an enlarged view illustrating the positioning of a support or extension post on a spike to be driven into the ground.

FIG. 5 is a cross-sectional view taken along lines 5—5 of FIG. 4.

FIG. 6 is a partial view of a clamp for supporting signs on another type of upright support means.

BEST MODE FOR CARRYING OUT THE INVENTION

FIG. 1 depicts a standard, indicated generally at 10, for providing and displaying a sign 12 mounted on support means 14. Base means, such as the base means depicted in FIGS. 4 and 7, which will be discussed in detail hereinafter, or any other base means may be provided.

Figure 11:
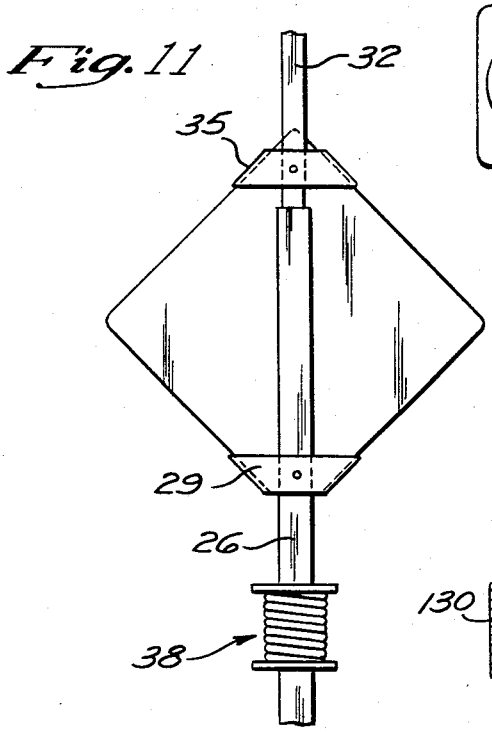
FIG. 11 is a more detailed view of a means for supporting a sign on the standard.

The support means 14 comprises an elongate post 26 provided with flanges 28 and 30, which may be affixed to the support post 26 by a weldment, screw, bolt, or other fastener, and preferably are part of the single element 29, as best shown in FIG. 11. Post 32 is slidably and adjustably mounted within post 26 for reciprocal, telescoping motion. A flag mount **32*a* is formed on top of post 32 and a flange 35, (best shown in FIG. 11), including flanges 34 and 36 is attached to the post 32** in any convenient manner.

A flexible, resilient device, indicated generally at 38 is attached to the bottom of post 26, closely subjacent to the sign mounting flanges 28 and 30, which permits the sign to flex, when acted upon by the wind or other force, to the position shown in phantom lines, or to any other position from horizontal to vertical, depending upon the degree of force applied to the sign, or to the post 32. Generally, the invention finds the greatest present applicability in connection with holding signs which are resiliently bent over by the wind, in which case the wind resistance of the post is negligible. In other applications force may be applied to the post, however.

Any resilient mechanism which permits the upper portion of the standard, comprising posts 26 and 32, to bend over relative to the lower portion of the standard, comprising post 24, and any extension segments which may be included in the lower portion, may be utilized. In addition to the form of the resilient mechanism 38 depicted in FIG. 1, the mechanisms depicted in FIGS. 12 through 17, inclusive, as well as others may be used.

In the particular embodiment depicted in FIG. 1, the resilient mechanism 38 comprises a pair of side-by-side coil springs 40 and 42 which are in contact with each other. These springs are secured between a pair of opposed plates 44 which are welded, or otherwise attached, to the bottom of the post 26, closely subjacent to the flanges for mounting the sign. The distance between the sign and the plate 46 may be a few inches, generally not greater than about one foot, subjacent the sign holding flange assembly 29.

In a convenient and preferred embodiment, a plate 46, at the bottom of the resilient support means is attached to a slide bracket for connecting the support means to the top of the post 24. The slide attachment bracket comprises a plate 48, which is attached directly to the plate 46, to which is welded or otherwise attached a slidable insert member 50 which is dimensioned and structured to be slidably received in the post 24. The insertion position is shown in FIG. 2 and the limiting, fully inserted, position is shown in FIG. 3.

The post 24, in the embodiment of FIG. 1, positions the flexible sign support mechanism 38 well above the supporting surface or base and immediately subjacent the sign to be supported. By so positioning the sign and supporting it in this manner, a sign may be positioned at considerable heights above the support surface without increasing significantly the mass or weight required of the base or the risk of the sign blowing over. This is in contrast with the prior art in which larger and higher signs were impossible to use without a significant increase in the weight and size of the base. The total moment arm needed to be absorbed by the resilient means 38 extends upwardly from the resilient means which, in turn, is elevated substantially above the base or the support surface, because the coupling 24, and other extensions, raise not only the sign but the resilient means as well. Thus, less moment need be absorbed by the resilient means than if the resilient means were mounted on the base, or near the surface on which the standard is supported.

The standard of this invention may be supported in any convenient manner, either temporarily or permanently, either by a fixed mount or by a portable mount.

One such base is depicted in FIG. 4 where a stake 52 is simply driven into the ground along side the road, in the parking lot, in the entrance way, or wherever the sign is to be mounted. This may be either a temporary or a permanent mounting position. Usually if the sign is to be permanently mounted in that location then a longer sturdier stake will be used than might otherwise be the case but the structure is identical except for size in all significant respects as between a temporary positioning of the sign standard and a permanent mounting of a standard in a given location. The stake serves as a base and if, in the exemplary embodiment depicted in FIG. 4, it is circular in cross-section a restraining member 54 may be provided to prevent rotation of the post 24 on the stake, by wedging the restraining member 54 into an interior corner of post 26 tightly against the outer surface of the stake 52, as shown in FIG. 5. Square or other stakes may, of course, be used.

The entire resilient means 38 and the sign closely above it, may be supported by any other convenient structure. For example, in FIG. 6, the resilient means is supported well above the surface on concrete guard rails commonly known as "Jersey rails." The clamping bracket generally indicated at 56 includes a pair of interconnected and opposed angle members 58 and 60 which are bridged by suitable cross members, one of which is indicated at 62. The angle members 58 and 60 are dimensioned to be mounted on top of the rail 54, only a portion of which is illustrated. The rail, of course, may be a fence rail, the top of another sign or any other comparable structure. An upright coupling post 66 is, in the exemplary embodiment depicted in FIG. 6, welded to the top of the cross member 62 and extends upwardly therefrom. The upper portion of the support means, indicated generally at 68, of the type previously discussed, is connected to the post 66, with a slidable insert of the type described in reference to element 50 in FIG. 2 and FIG. 3.

Figure 7:
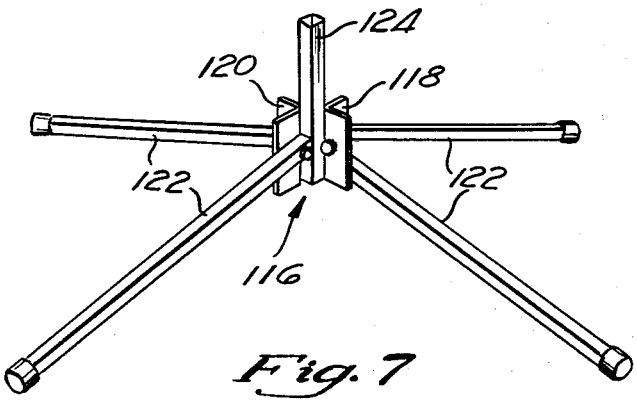
FIG. 7 illustrates one form of a portable base which may be used in connection with the present invention.

A common portable base is shown in FIG. 7, and is generally indicated at 116. The angle brackets 118 and 120 serve as mounting for adjustable legs 122 and support an upright hollow post, of the type previously described and typified by the post 24, 124 in FIG. 7.

Figure 8:
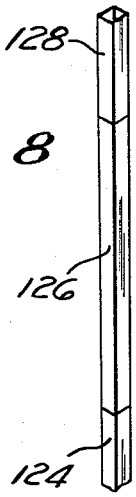
FIG. 8 illustrates an extension post element which comprises part of the invention.

FIG. 8 depicts another important feature of the invention. One or more extension posts 126 and 128, depicted in FIG. 8, may be used to position the resilient means 38 at any desired height above the base or support surface.

Figure 10:
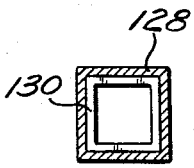
FIG. 10 is a cross-sectional view of the post of FIG. 9 taken along lines 10—10 in the direction of the arrows.
Figure 9:
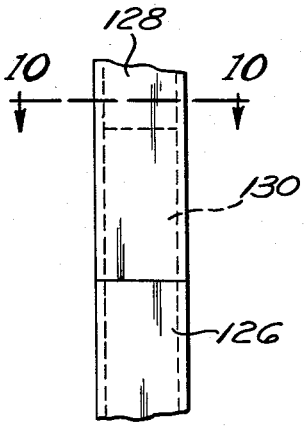
FIG. 9 is an enlarged view of the joint of the extension post of FIG. 8 showing the means for connecting the extension posts together.

As many extension poles as may be desired may be utilized. They may be connected together, end-to-end, in any desired manner. It is convenient in the presently preferred embodiment, but not particularly important to the overall invention, to provide a hollow tubing insert 130 which is welded, pressed, bolted or otherwise fastened into the bottom end of post 128 and is slidably received into the top of post 126, as depicted in FIGS. 9 and 10.

While the mechanism is comparatively simple, the consequences and importance of this contribution are quite significant. Heretofore, the only way to place a sign high in the air was to lift the base onto a large and, usually, very substantial platform or to extend the height of the sign or to position the sign at the top of a post which was supported on the bottom by resilient means. None of the alternatives were satisfactory, notwithstanding that those working in the art have spent many, many years in attempting to meet these problems. Thus, while the devices themselves are relatively simply mechanical devices, they coact and work together in a synergistic way never before contemplated to provide an achieved result never before achieved; namely, the provision of a sign at a substantial height above the surface, or the base, which is readily flexible closely subjacent the sign and which does not turn over upon the application of a force, e.g. in a wind.

FIG. 11 depicts a typical assembly of the upper portion of the standard including the resilient means, the post 26 to which the sign bracket 29 is attached, the post 32 slidably received in the post 26, to which the sign mounting bracket 35 is attached. As previously indicated, the resilient means 38 may be any of many different designs, one of which is shown in FIGS. 1, 2, 3 and 6.

Figure 12:
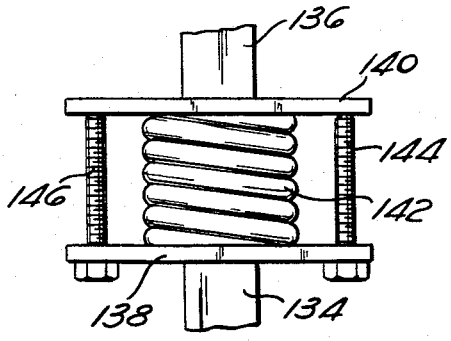
FIG. 12 is one embodiment of a resilient means which comprises part of the standard for supporting the sign.

Another type of resilient configuration is shown in FIG. 12, comprising a lower support post 134 to which a plate 138 is attached, permanently or temporarily, by any convenient means and an upper post portion 136 to which a plate 140 is similarly attached. A spring 142 is attached to the respective plates 138 and 140, in any convenient manner to provide the flexibility. In order to assure that flexibility is provided only in one plane, means 144 and 146, in the particular embodiment bolts or pins 144 and 146, extend between the two plates to permit the upper plate 140 to pivot forward and backwardly in one plane, but not side-to-side. Obviously, any means which will prevent the downward tilting of the left and right sides of plate 140, as viewed in FIG. 12, will accomplish the same result.

Figure 14:
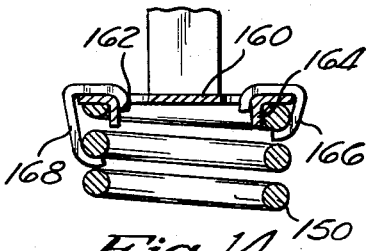
FIG. 14 is a side view, showing the spring in partial cross-section of an alternative embodiment of the resilient means for supporting the sign, showing a particular means for securing the spring to the plate.
Figure 13:
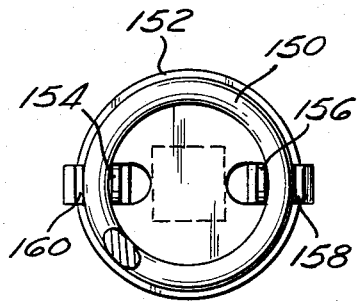
FIG. 13 is a top view, showing a portion of the spring cutaway in cross-section.

FIG. 13 depicts a circular spring 150, only part of which is shown and the end of which is shown in cross-section, attached to a plate 152. The spring is kept centered on the plate 152 by means of ears 154 and 156 formed from the plate 152 and the spring is mounted on the plate by means of clips 158 and 160, the construction of which is better shown in FIG. 14, which is the upper half of a resilient assembly, the bottom of which is shown in FIG. 13. The plate 160, in FIG. 14, is analogous and a mirror image to the plate 152 and has formed from it ears 162 and 164. Two ears are shown but four or more ears could be provided if desired to assure centering of the spring on the plate. Generally U-shaped clips 166 and 168 engage around one or more coils of the spring, with a tip being found between the spring coils, and around the plate and into the opening formed by bending up the ears 162 and 164. By forming the clips 166 and 168, and comparable clips 158 and 160, of spring steel, these clips may be simply snapped into place and will securely hold the spring in position.

Figure 16:
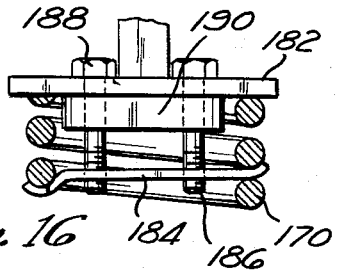
FIG. 16 is a side view, of a portion, showing the spring and partial cross-section, of an alternative embodiment of the flexible means for supporting the sign, in which the spring is in a generally rectangular configuration showing another mechanism for clamping the spring to a base plate.
Figure 15:
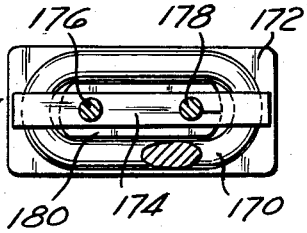
FIG. 15 is a top view of a portion, showing a spring and partial cross-section.

A generally rectangularly configured spring 170 is utilized in the embodiment of FIGS. 15 and 16, which are the bottom, shown looking downwardly, and the top, in partial cross-section, of another embodiment of a flexible mechanism. The configuration of the spring is generally rectangular with the corners being curved, of course. The spring is mounted on a plate 172 by means of a crossbar 174 and a pair of bolts 176 and 178. These bolts serve only to clamp the bar 174 and do not position the spring. The spring is positioned by means of a boss 180 which centers the spring and secures it in the proper position in the plate. Two bolts, 176 and 178 are used only to avoid interference with the support post and one bolt could just as easily be used. That is, the two bolts are exactly and completely identically equivalent to one bolt in this clamp. Indeed, one bolt 176 could be used even in this embodiment with the bolt off-center. The clamping arrangement is more easily determined from FIG. 16 in which the spring 170 is held against a plate 182 by means of a crossbar 184 and a pair of bolts 186 and 188, the spring being held in its proper position by an upwardly extending boss 190, around which the spring rests.

Figure 17:
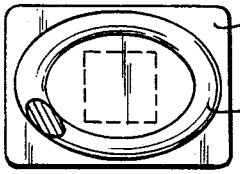
FIG. 17 is the top view of a portion of flexible means for supporting the sign in which the spring is in a non-circular, generally oval configuration, the spring being shown in partial cross-section.

Omitting the details of the fastening means for the spring to the plate, FIG. 17 shows a similar structure in which a spring 192 in generally oval configuration is fastened to a plate 194.

There is an advantage in using a noncircular spring. With a circular spring, the resilience is approximately equal in 360°. If a noncircular spring is used, the spring will be more resilient, or more easily bent, in one plane, typically. For example, by using the oval or rectangular configuration of spring, the sign supported thereon will tend to tilt back and forth in one plane, but not side-to-side. Other noncircular configurations may, of course, be used with the same general result. A triangular configured spring in which the sign was mounted in a plane parallel to one side of the triangle would tend to tilt only in one direction, if this were desirable in a given circumstance.

It will be recognized that in the foregoing examples, typical means for connecting the spring to the plate, or other mechanism or means to secure the resilient spring to the posts, have been described. There are hundreds of other mechanisms and approaches which can be used to attach the springs with the same result. For example, using circular springs one can screw the spring onto a properly threaded boss which would extend 1 or 2 turns into the spring, the spring may be welded to the plate or to the post, the spring may be formed with a threaded end which can be screwed into a receiving threaded nut or aperture, the ends of the spring may be adhesively bonded to the plate or in a cup mounted on a plate, or any number of small clamps may be utilized around te periphery of the spring to clamp it to the plate. Many other extremely simple mechanisms may be used, such, for example, as that described by Hillstrom.

From the foregoing discussion, it will be apparent that the present invention provides a result not before accomplished through arrangements which are novel and which bring together mechanical elements in a new and unique interaction wherein the elements coact with one anoher to permit a sign at an elevated position above a support surface or base to tilt in the wind or upon the application of force without exerting force on the base, or on the support post, by reason of a tilting moment arising from the tilting of the post, as has been the case in the prior art. Furthermore, the signs of this invention may be made to extend as far as desired above the base or the surface. Extension posts, typically ranging from 15 to 16 inches in length, may be provided, singly or end to end.

In the most common present application, the sign is supported at least about two thirds the height of the sign above the surface; i.e. the bottom of the sign is at least about two thirds as high above the support surface as the height of the sign itself. Thus, a sign three feet high would normally be supported about two feet, within a wide margin, above the ground, or other support surface. Small signs might well be supported several times the height of the sign above the surface. While the distance of the resilient means below the sign, when the standard is in use supporting a sign, may vary, the distance will nearly always be less than one-half the sign height below the sign and generally less than one foot below the sign. Thus, if a three-foot high sigh is to be mounted, the resilient means would not be more than one and one-half feet below the sign and generally would be less than one foot, typically only a few inches, below the bottom of the sign. Such a relationship is referred to as closely subjacent herein for simplicity. The relationships just discussed have not, to my knowledge or information, been embodied in any prior sign standard and result in new and extremely valuable functions and advantages which were not predicted by those who have worked in the art for many years.

Another contribution of this invention is the provision of noncircular springs which control the plane of resiliency of the sign. These and other significant benefits grow out of the present invention.

INDUSTRIAL APPLICATION

The present invention finds its greatest present industrial application in highway signs used in connection with construction, road damage, temporary emergency situations and the like. The present invention is not so limited, however, and may be used in service stations, and in commercial establishments generally. The present invention is typically used to prevent a sign from being blown over by the wind but it may be used to prevent a sign from being destroyed, pushed over, or otherwise displaced by the exertion of force from any source.

What is claimed is:

1. A windproof sign stand, comprising:

a base;

a first post connected to the base and having an end extending therefrom;

spring means connected to said end of the first post extending away from the base;

means for adjusting the distance between the spring means and the base;

a second post connected to the spring means such that the spring means is between the first and second post;

a third post mounted to the second post to have a range of slidably adjustable, reciprocal telescoping motion therewithin;

a first sign mounting flange connected to the second post for securing a first portion of a sign thereto; and a second sign mounting flange connected to the third post for securing a second portion of a sign thereto, the first and second mounting flanges and the range of motion of the third post within the second post cooperating to permit adjustment of the distance between the first and second sign mounting flanges, the spring means, said spring means, adjusting means and the first, second and third posts cooperating to support the sign at a predetermined distance from the base such that the sign tilts in response to wind forces thereon, thereby limiting tilting moments about the base resulting from wind forces on the sign.

2. The windproof sign stand of claim 1 wherein said base includes:

a stake which may be driven into the ground, the first post being slidably receivable over the stake; and retaining means to prevent rotation of the first post on the stake.

3. The windproof sign stand of claim 1 wherein the base includes clamp means for clamping the sign stand to a rail.

4. The windproof sign stand of claim 1 further comprising:

a plate connected to said spring means; and an insert member connected to the plate, said insert member being dimensioned and formed to be slidably received in the end of the first post for positioning the plate and spring means a predetermined distance from the base.

5. The windproof sign stand of claim 4 wherein the spring means comprises a single coil spring, further comprising:

a pair of ears extending from the plate to position said single coil spring on said plate; and a plurality of generally U-shaped clips, each having a first leg formed to engage a coil of the coil spring and a second leg formed to engage the plate, each of said plurality of clips being formed of a resilient material such that the clips may be snapped into place to retain the coil spring upon the plate.

6. The windproof sign stand of claim 1 wherein the first and second sign mounting flanges and the second and third posts cooperate to permit adjustment of the distance between the sign and the spring means.

* * * * *